US007826757B2

(12) United States Patent
Akita

(10) Patent No.: US 7,826,757 B2
(45) Date of Patent: Nov. 2, 2010

(54) IMAGE FORMING APPARATUS

(75) Inventor: Masanori Akita, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 425 days.

(21) Appl. No.: 11/957,979

(22) Filed: Dec. 17, 2007

(65) Prior Publication Data

US 2008/0152370 A1 Jun. 26, 2008

(30) Foreign Application Priority Data

Dec. 22, 2006 (JP) ..... 2006-346802

(51) Int. Cl.
*G03G 15/043* (2006.01)
*G03G 15/00* (2006.01)

(52) U.S. Cl. ..... 399/51; 399/49

(58) Field of Classification Search ..... 399/49, 399/51, 52

See application file for complete search history.

(56) References Cited

U.S. PATENT DOCUMENTS 5,381,221 A * 1/1995 Mizoguchi et al. ..... 399/40
5,983,045 A * 11/1999 Suzuki et al. ..... 399/51
6,567,171 B1 * 5/2003 Rushing ..... 356/432
6,954,285 B2 10/2005 Ogata et al.
7,616,908 B2 * 11/2009 Watanabe et al. ..... 399/49

FOREIGN PATENT DOCUMENTS

| | | | |
|---|---|---|---|
| JP | 8-110700 | A | 4/1996 |
| JP | 10-39608 | A | 2/1998 |
| JP | 10-186747 | A | 7/1998 |
| JP | 2001-13742 | A | 1/2001 |
| JP | 2001-296732 | A | 10/2001 |
| JP | 2002-23436 | A | 1/2002 |

* cited by examiner

*Primary Examiner*—David M Gray
*Assistant Examiner*—Joseph S Wong
(74) *Attorney, Agent, or Firm*—Fitzpatrick, Cella, Harper & Scinto

(57) ABSTRACT

An image forming apparatus includes an exposure area controller for controlling an exposure area per pixel of an exposure device on the basis of image information and a switching device for switching an amount of exposure so as to decrease an exposure intensity of the exposure device during reference toner image formation and increase the exposure area per pixel of the exposure device when compared with those during normal image formation.

6 Claims, 7 Drawing Sheets

IMAGE FORMING APPARATUS

FIELD OF THE INVENTION AND RELATED ART

The present invention relates to an image forming apparatus using an electrophotographic method, an electrostatic recording method, etc., particularly an image forming apparatus, such as a copying machine, a printer, or a facsimile machine.

The electrophotographic method or the electrostatic recording method is one of well-known printing methods used for the copying machine or the printer. In recent years, with print on demand (POD), high-speed printing performance, picture image printing and the like, a resultant high level print image quality with a high definition is desired.

In an image forming apparatus using the electrophotographic method or the electrostatic recording method, a latent image is formed on a photosensitive member as an image carrying member with a laser and is visualized with toner and a visualized toner image is formed on a recording material. When the latent image is formed on the image carrying member, a method in which a laser intensity is changed every single pixel depending on an image density may be used. However, in execution of tone gradation printing by switching the laser intensity for each pixel, a laser switching speed is not performed in time for a scanning time for one pixel. For this reason, the method is difficult to be employed in image forming apparatuses in these days required for high resolution and high speed. Therefore, a so-called area modulation method in which the laser intensity is made uniform for all the pixels and a laser driving pulse with a width (a laser emission time length) corresponding to a density level is utilized.

Incidentally, generally, in a developing apparatus provided to the image forming apparatus using the electrophotographic method or the electrostatic recording method, a one component developer principally comprising magnetic toner or a two component developer principally comprising non-magnetic toner and a magnetic carrier is used. Particularly, in color image forming apparatuses for forming a full-color or multi-color image using the electrophotographic method, almost all of developing apparatuses employ the two component developer from the viewpoint of coloring of the image or the like.

As is well known, a T/D ratio (a ratio of a toner weight to a total weight of a carrier and toner) of the two component developer and a charging amount of the toner are very important factors for stabilizing image qualities. The toner in the developer is consumed during development to lower the T/D ratio and at the same time, the toner charge amount is increased, thereby lowering an image density. For this reason, it is necessary to always control the T/D ratio or the image density at a constant level to retain the image quality by using a developer density control apparatus or an image density control apparatus so as to detect a developer of the developer or an image density at appropriate times and to supply the toner depending on a change of the detected density.

In an image forming apparatus shown in FIGS. 9 and 10, in order to control the T/D ratio of the developer or a triboelectric charge (image density) at a constant level by effecting control of toner supply to a developer 21 in a developing apparatus 21 in an amount corresponding to toner consumed for development, density control apparatuses (ATR) of various types are provided and specific examples thereof may include:

(1) a type wherein a T/D ratio of the developer 21 in the developing apparatus 21 is detected as reflected light quantity by a T/D ratio sensor 23 provided in the developing apparatus 20 and is controlled (developer reflection ATR), (2) a type wherein a patch image 26 for reference purposes is formed on a photosensitive drum 40 and an image density thereof is detected by a sensor 27, such as a potential sensor disposed opposite to the photosensitive drum 40 and is controlled (patch detection ATR), and (3) a type wherein a necessary toner amount is computed from an output level of a digital image signal for each pixel sent from a video counter 4 (video counter ATR).

In either case, on the basis of information obtained in each of the types, the supply control of toner to the developer 21 in the developing apparatus 20 is performed by controlling rotation of a motor 28 by a CPU 6 through a motor driving circuit 7. As a result, the T/D ratio or the image density is kept at a constant level.

For example, as described in Japanese Laid-Open Patent Application (JP-A) Hei 08-110700, JP-A Hei 10-39608, and JP-A 2001-296732, a developer density control apparatus using a method for directly measuring the T/D ratio (so-called light ATR, inductance control, or the like) conventionally performed in a two-component developing apparatus is principally directed to stabilize the T/D ratio. For this reason, the T/D ratio is stabilized but the density control apparatus cannot follow a change in a toner charge amount (triboelectric charge) due to a change in carrier charging power, standing for a long time, an abrupt change in mounting environment of an image forming apparatus, or the like. As a result, unacceptable changes in coloring and density can be caused.

As is well known, in a developing step, a potential difference of a developing contrast (Vcont) between an exposure potential (V1) and a developing potential (Vdc) created on the photosensitive drum is compensated by the toner electric charge.

Accordingly, the change in triboelectric charge of the toner means a change in amount of the toner with respect to a predetermined potential difference Vcont, i.e., a density. In order to prevent the change in density, it is possible to stabilize the amount of the toner on the photosensitive drum by changing Vcont depending on the change in triboelectric charge of the toner. However, the change in triboelectric charge of the toner largely affects a transfer property in a transfer step subsequent to the developing step, so that the change in triboelectric charge of the toner also largely affects an image on a transfer material.

In view of these circumstances, a so-called patch detection ATR is conventionally performed for the purpose of stabilizing the triboelectric charge of the toner in the developing apparatus. More specifically, in the patch detection ATR, a certain reference patch (reference toner image) is appropriately formed on the photosensitive drum and a density of the patch is compared with that at an initial stage and then toner supply control is effected depending on a result of the comparison.

The patch detection ATR is not performed by detecting the toner triboelectric charge itself but is performed by detecting a patch density on the photosensitive drum at the predetermined Vcont with a patch sensor to carry out the toner supply control by estimating the amount of the toner triboelectric charge from detected data by the patch sensor. This patch detection ATR is based on the premise that the potential difference Vcont is represented by: Vcont=toner triboelectric charge (Q/M)×toner amount (M/S).

That is, in the case where the patch density is detected that it is lower than a pre-set reference density, this is comparable to a higher toner triboelectric charge compared with the reference value, so that the T/D ratio is increased by supplying the toner in order to lower a current amount of the triboelectric charge. On the other hand, in the case where the patch density is detected such that it is higher than the pre-set reference density, this is comparable to a lower toner triboelectric charge compared with the reference value, so that the T/D ratio is decreased by toner consumption by image formation after the toner supply is stopped, in order to increase the current amount of the triboelectric charge.

As the above-described patch detection ATR, an optical sensor constituted by a light-emitting element such as an LED or the like, and a light-receiving element such as a photoelectric conversion element, is generally used widely. This optical sensor detects a toner density from a difference in reflectance between a toner image and its background (image carrying member surface) with respect to incident light from the light-emitting element. Accordingly, in a high density area, the toner images overlap with each other in a layer, so that the optical sensor for detecting the toner density by reflected light from the toner image surface is remarkably lowered in sensitivity of the toner density (toner amount). Further, in a low density area, an output of the reflected light from the toner layer is small, so that the sensitivity is lowered.

For the reasons described above, as the density of the patch image for the patch detection ATR, a halftone density of about 0.5-1.0 providing a good sensitivity of the optical sensor may suitably be used.

JP-A 2002-23436 proposes a method in which a rectangular wave is used as a waveform of a developing bias during ATR patch image formation and a blank pulse is used during normal image formation in order to satisfactorily reflect a change in T/D ratio (triboelectric charge) of a developer on a patch density in a patch detection ATR. This method utilizes such a characteristic that in the case of using the rectangular wave as the developing bias waveform, the T/D ratio is satisfactorily reflected and in the case of using a blank pulse, the photosensitive drum density is less affected by the T/D ratio.

However, in the case where the patch image with the halftone density is formed by the so-called area modulation method, the triboelectric charge of the toner in the developing apparatus can be unstable even when the conventional patch detection ATR is employed.

As a result of study by the present invention the relationship: Vcont=(toner triboelectric charge)×(toner amount) which is the premise condition for the patch detection ATR, it was found that the relationship is satisfactorily established at a potential V1(2) of a uniform latent image (so-called solid latent image) as shown in FIG. 12 but is not completely satisfied microscopically at a potential V1(1) of a rectangular latent image (halftone image) as shown in FIG. 11. Details thereof will be described later.

The latent image potential of the patch image with the halftone density of about 0.5-1.0 suitably used for the patch detection ATR is in state of the above-described rectangular latent image potential in the case where the latent image is formed by the so-called area modulation method. That is, even when the toner supply control is effected by detecting the patch density (toner amount), a correlation between the toner triboelectric charge and the patch density is originally poor, so that there arises a problem that accuracy of triboelectric charge control in the developing apparatus is remarkably lowered. Therefore, the conventional patch detection ATR has room to study.

Incidentally, when the patch image for the patch detection ATR is the so-called solid latent image which is formed in a uniform potential state, the relationship of Vcont=(toner triboelectric charge)×(toner amount) is satisfactorily established. However, as described above, in the high density area, such as a solid image density area, a sensitivity of a patch reading sensor is low, so that it is difficult to effect the control of the toner triboelectric charge in the developing apparatus. Further, from the viewpoint of toner consumption amount, the formation of the high density patch image is undesirable. Further, when the formed patch image is removed, the high density patch image has a large amount of toner, so that there is possibility of so-called defective cleaning.

SUMMARY OF THE INVENTION

A principal object of the present invention is to provide an image forming apparatus capable of satisfactorily performing triboelectric charge control in a developing apparatus even when toner supply is effected on the basis of a result of detection of an ATR patch with a halftone level in the image forming apparatus in which image formation is effected by an area modulation method.

A specific object of the present invention is to provide an image forming apparatus capable of forming a good image for a long term while suppressing changes in coloring and density at low levels.

According to an aspect of the present invention is to provide an image forming apparatus comprising:

an image carrying member for carrying a toner image;

exposure means for forming an electrostatic latent image by exposing the image carrying member to light on the basis of image information;

developing means for developing the electrostatic latent image with a developer comprising toner and a carrier;

density detecting means for detecting a density of a reference toner image formed by the developing means;

supply control means for controlling an amount of toner supplied to the developing means on the basis of a detection result of the density detection means;

exposure area control means for controlling an exposure area per pixel of the exposure means on the basis of the image information during normal image formation for forming a toner image on a recording material; and switching means for switching an exposure condition for forming an electrostatic latent image corresponding to the same density level between during reference toner image formation and during the normal image formation, wherein the switching means switches the exposure condition so that an exposure intensity during the reference toner image formation is smaller than that during the normal image formation and an exposure area per pixel during the reference toner image formation is larger than that during the normal image formation.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the present invention will be described more specifically with reference to the drawings.

Embodiment 1

First, a general structure of an image forming apparatus of the present invention in this embodiment will be described with reference to FIG. 1. In this embodiment, the image forming apparatus is an electrophotographic digital copying machine but the present invention can also be equivalently carried out in various image forming apparatuses using an electrophotographic method or an electrostatic recording method.

In this embodiment, the image forming apparatus includes a drum-like electrophotographic photosensitive member as an image carrying (bearing) member, i.e., a photosensitive drum 40 and an exposure apparatus 100 for forming an electrostatic latent image depending on an image information signal on the photosensitive drum 40. The electrostatic latent image formed on the photosensitive drum 40 is developed by a developing apparatus 44 with a developer comprising toner and a carrier into a toner image.

The exposure apparatus 100 as an exposure means will be described below.

Figure 1:
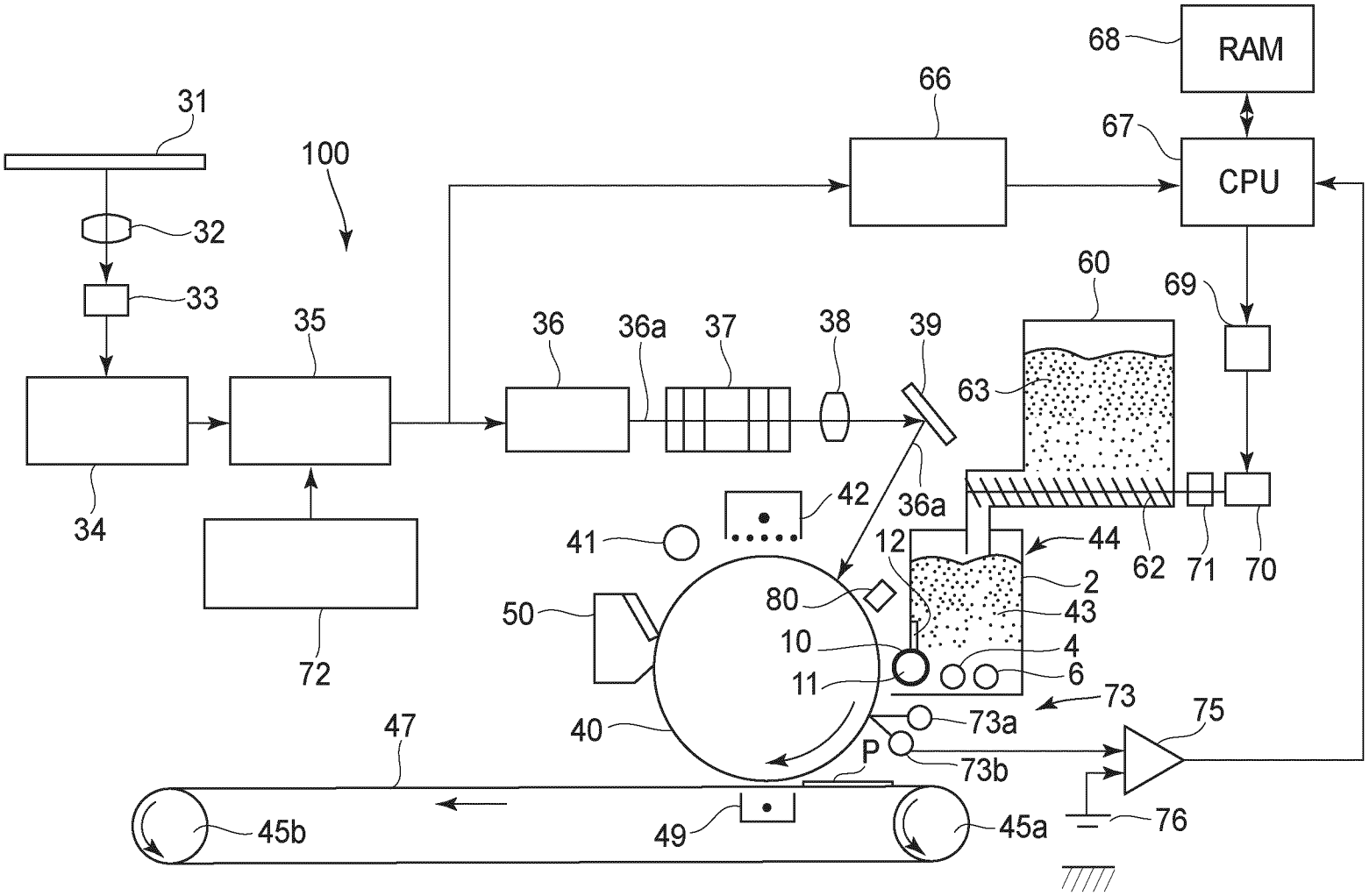
FIG. 1 is a schematic structural view showing an embodiment of the image forming apparatus according to the present invention.

In FIG. 1, an image of an original 31 to be copied is projected on an image-pickup device 33, such as a CCD, through a lens 32. The image-pickup device 32 divides the original image into a large number of pixels and generates a photoelectric conversion signal corresponding to the density of each of the pixels. An analog image signal outputted from the image-pickup device 33 is sent to an image signal processing circuit 34, in which the signal is converted into a pixel image signal (input image density signal) with an output level corresponding to a pixel density for each pixel and is then sent to a pulse width modulation circuit 35.

Figure 2:
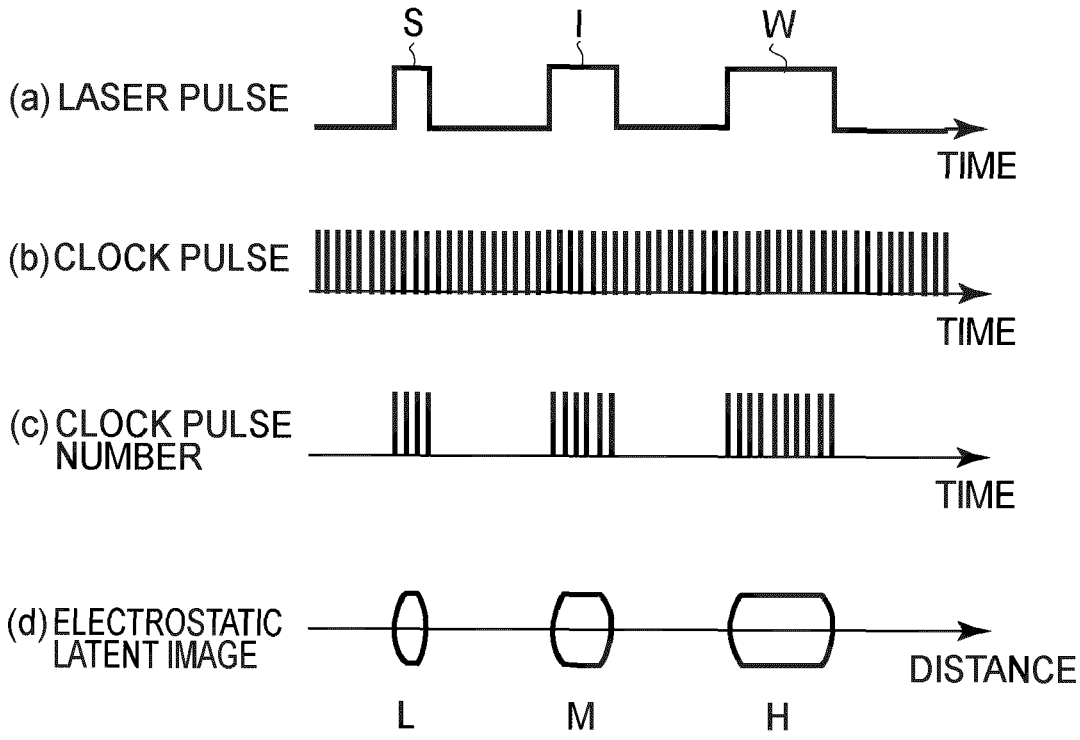
FIGS. 2(*a*) to 2(*d*) are schematic diagrams for illustrating laser signal control in Embodiments 1 and 2 of the present invention.

In the exposure apparatus 100, the pulse width modulation circuit 35 as an exposure area control means has the function of forming a latent image by the so-called area (laser emission time) modulation method in which a laser drive pulse with a width (time length) corresponding to a level of the inputted pixel image signal is formed and outputted for each pixel image signal. More specifically, as shown in FIG. 2, the pulse width modulation circuit 35 outputs a broad driving pulse W with respect to a high density pixel image signal, a narrow driving pulse S with respect to a low density pixel image signal, and a medium-width driving pulse I with respect to a medium density pixel image signal.

The laser drive pulse outputted from the pulse width modulation circuit 35 is supplied to a semiconductor laser 36 and causes the semiconductor laser 36 to emit a laser beam 36 for a time corresponding to a pulse width of the pulse. Therefore, the semiconductor laser 36 is actuated for a larger time with respect to the high density pixel and for a shorter time with respect to the low density pixel. For this reason, the photosensitive drum 40 is exposed to the laser beam 36 in a long range at the high density pixel and a short range at the low density pixel, with respect to a main scanning direction by an optical system described below.

The laser beam 36*a* emitted from the semiconductor laser 36 is swept by a rotatable polygonal mirror 37 provided to a laser beam scanner constituting the exposure apparatus 100. The beam is formed as an image at a spot on the photosensitive drum 40 through a lens 38, such as f/θ lens or the like, and a fixed mirror 39 for directing the laser beam 36*a* toward the photosensitive drum 40. As a result, the surface of the photosensitive drum 40 as the image carrying member is subjected to scanning with the laser beam 36*a* with respect to a direction (main scanning direction) parallel with a rotational axis of the photosensitive drum 40, thus forming thereon an electrostatic latent image.

The photosensitive drum 40 is a drum-like electrophotographic photosensitive member which has a photosensitive material, such as amorphous silicon, selenium, an OPC at its surface and is rotated in a direction of an indicated arrow, and is electrically charged uniformly by a primary charger 42 after being electrically discharged uniformly by an exposure device 41. Thereafter, the surface of the photosensitive drum 40 is subjected to exposure scanning by the exposure apparatus 100 with the above-described laser beam 36*a* modulated corresponding to the image information signal, thus forming thereon the electrostatic latent image corresponding to the image information. The electrostatic latent image is reversely developed by the developing apparatus 44 as the developing means using the two component developer comprising the toner and the carrier in mixture, thus being visualized as a toner image. The reverse developing method is a developing method in which toner electrically charged to a polarity identical to be a polarity of the latent image is deposited in an area of the photosensitive drum 40 exposed to the laser beam to visualize the latent image as a toner image.

In this embodiment, an image forming means is constituted by the photosensitive drum 40 as the image carrying member, the primary charger 42 as the charging means, the exposure apparatus 100, and the developing apparatus 44 as the developing means.

The toner image formed on the photosensitive drum 40 by the image forming means is transferred onto a transfer material P, conveyed to the photosensitive drum 40 by a transfer material carrying belt 47, by the action of a transfer charger 49. The transfer material carrying belt 47 is stretched between two rollers 45*a* and 45*b* and is driven along an endless path in a direction indicated by an arrow to convey the transfer material P held thereon to the photosensitive drum 40. The transfer material P onto which the toner image is transferred is separated from the transfer material carrying belt 47 and conveyed to an unshown fixing device to be fixed as a permanent image. Residual toner remaining on the photosensitive drum 40 after the transfer is removed by a cleaning apparatus 50.

Incidentally, for simplification of illustration, in FIG. 1, only a single image forming station (including the photosensitive drum 40, the exposure apparatus 100, the primary charger 42, the developing apparatus 44, and the like) is shown as the image forming means. In this embodiment, however, the image forming apparatus is a color image forming apparatus provided with image formation stations for, e.g., cyan, magenta, yellow and black. Therefore, these image forming stations are successively arranged along a movement direction of the transfer material carrying belt 47. At the respective image forming stations, electrostatic latent images as color component images for respective colors obtained by color separation of the original image are successively formed a photosensitive drums for the image forming stations, respectively, and are developed by developing apparatuses using developers containing corresponding color toners, respectively, into color toner images. These toner images on the respective photosensitive drums 40 are successively transferred onto the transfer material P conveyed by the transfer material carrying belt 47 in a superposition manner.

Figure 10:
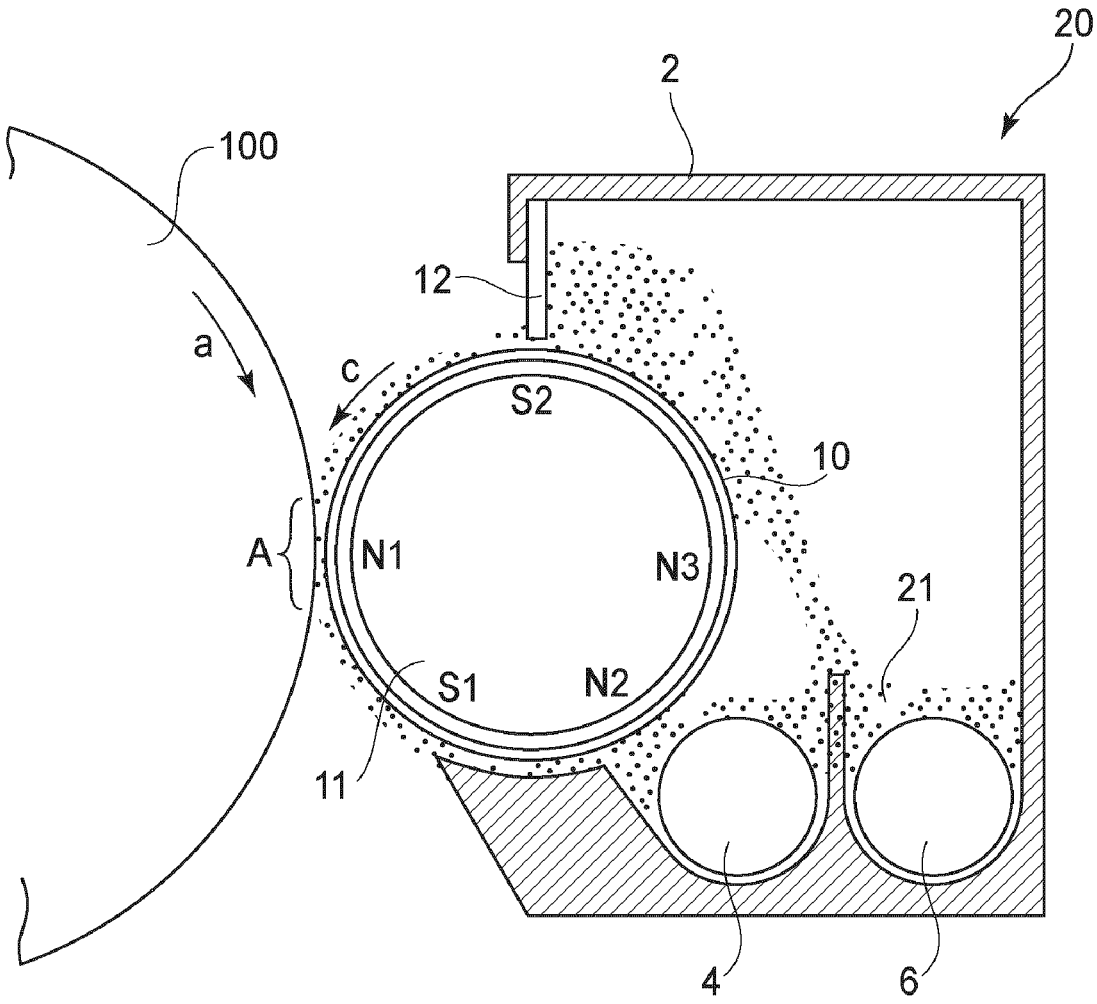
FIG. 10 is a schematic structural view showing an embodiment of a conventional developing apparatus.

The developing apparatus 44 has the same constitution as that of the developing apparatus shown in FIG. 10 described above. That is, the developing apparatus 44 includes a developing container 2 accommodating a two component developer 43 containing a magnetic carrier and non-magnetic toner. In the developing container 2, a developing sleeve 10 as a developer carrying member formed of a non-magnetic material, such as SUS, is provided opposite to the rotating photosensitive drum. Other constitutions are similar to those shown in FIG. 10, thus omitting redundant description.

In this embodiment, above the developing apparatus 44, a toner supply tank 60 accommodating supply toner 63 is mounted as shown in FIG. 1 and at the bottom portion of the toner supply tank 60, a toner conveying screw 62 is provided. By rotationally driving the toner conveying screw 62 by a motor 70 connected thereto through a gear train 71, the toner 63 in the supply tank 60 is conveyed and supplied into the developing apparatus 44. The supply of the toner by the toner conveying screw 62 is controlled by controlling the rotation of the motor 70 by a CPU 67 through a motor driving circuit 69. In RAM 68 connected to the CPU 67, control data and the like sent to the motor driving circuit 69 are stored.

By the development of the electrostatic latent image, the T/D ratio of the developer 43 in the developing apparatus 44 is lowered and at the same time, the triboelectric charge of the toner is increased, so that supply control for supplying the toner 63 from the toner supply tank 60 to the developing apparatus 44 is effected by a density control apparatus.

In this embodiment, by the density control apparatus, a method (patch detection ATR) in which the image density is detected by an image density sensor 73 as an optical image density detection means is carried out. More specifically, a patch image (reference toner image) for reference purposes is formed on the photosensitive drum 40 and an image density thereof is detected by the image density sensor 73 including a light-emitting portion 73*a* and a light-receiving portion 73*b* which are disposed opposite to the photosensitive drum 40 and on the basis of a result of the detection, the image density is controlled.

As described above, in this embodiment, optimization of the image density regarded as important in the market is intended by controlling the toner supply amount to the developing apparatus so as to optimize the density of the reference patch image thereby to always stabilize the triboelectric charge of the toner in the developing apparatus.

As described above, JP-A 2002-23436 has proposed the method such that in order to satisfactorily reflect the change in T/D ratio (triboelectric charge) of the developer on the patch density, the developing bias waveform used during the ATR patch image formation is a rectangular wave and that used during the normal image formation is a blank pulse. This is because in the case where the developing bias waveform is the rectangular wave, the T/D ratio is satisfactorily reflected and in the case where the developing bias waveform is the blank pulse, the patch density is less liable to be affected by the T/D ratio.

On the other hand, in the present invention, different from such a conventional method, the patch image is formed by changing a latent image pattern, not the developing bias. As a result, a sensitivity of the triboelectric charge is enhanced so as to satisfactorily reflect the T/D ratio on the patch density.

That is, according to the present invention, formation and detection of the patch image with a halftone density are performed by the latent image formed by a lowering the laser power (exposure intensity) to increase the exposure area. As a result, the patch density satisfactorily reflects the triboelectric charge. Accordingly, it is possible to increase accuracy of control of the triboelectric charge, i.e., the T/D ratio of the developer.

Generally, a similar effect can also be achieved by using an analog patch (formed by using a charge potential Vd and a developing Vdc without employing the exposure step) used for the ATR patch. However, in the analog patch formation, the patch image is formed in the entire thrust area (with respect to the axial direction of the photosensitive drum 40), so that the toner is unnecessarily consumed.

On the other hand, in the present invention, the patch image can be arbitrarily formed only in a range in which the patch detection can be performed, so that there is no unnecessary consumption of the toner. Further, the analog patch disadvantageously causes downtime. In other words, the developing bias is changed between during the analog patch image formation and during the normal image formation, so that the analog patch image formation cannot be effected simultaneously with the latent image formation.

On the other hand, in the present invention, the patch image formation is effected by only changing the laser power, so that the patch image formation can be effected simultaneously with the normal image formation. For example, the ATR patch image formation can be carried out in a non-image area or during sheet interval.

The latent image formation, during the reference patch image formation, characterizing the present invention will be described.

First, during the normal image formation, the image signal is converted into the pixel image signal (input image density signal) with an output level corresponding to the density at the pixel for each pixel and is sent to the pulse width modulation circuit 35 as described above. The pulse width modulation circuit 35 forms the latent image by the so-called area modulation method in which a laser drive pulse with a width (laser emission time length) corresponding to a level of each pixel image signal is formed and outputted. This area modulation method is not a distinctive method, so that the method is widely used in the image forming apparatuses, such as copying machines and the like, since the method is advantages for tone gradation printing. Incidentally, the laser intensity is uniformly identical with respect to all the pixels. That is, a laser drive current is made constant to keep a laser output at a constant level. When the tone gradation printing is performed by switching the laser intensity for each pixel, a laser intensity switching speed is not in time for one pixel scanning time, so that it is difficult for image forming apparatuses of these days required for high resolution and high speed to effect the tone gradation printing.

On the other hand, in the present invention, the latent image is formed by lowering the laser intensity compared with that during the normal image formation. This is because the latent image for the patch image is kept in a potential state at a level as uniform as possible, not a potential state with a microscopically uneven (rectangular) shape, in order to realize a strong correlation represented by: Vcont=(toner triboelectric charge)×(toner amount) as the premise condition for the patch detection ATR as described above.

The patch detection ATR, as described above, the relationship: Vcont=(toner triboelectric charge)×(toner amount) is employed. By detecting the density of the patch image formed by a predetermined Vcont, a triboelectric charge value of the toner in the developing apparatus is estimated.

Figure 11:
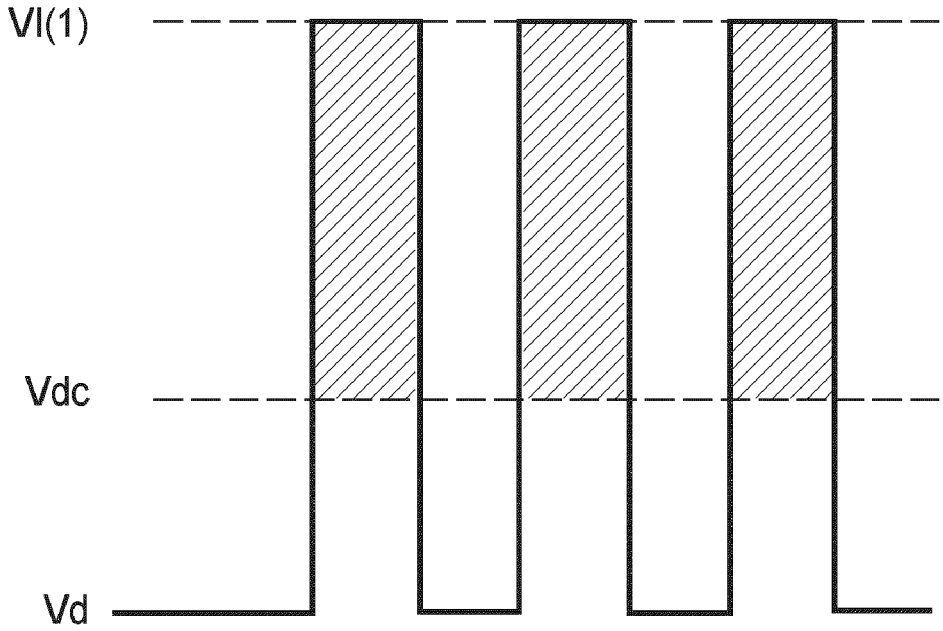
FIG. 11 is a schematic diagram showing a potential of a latent image with a halftone density during normal image formation.
Figure 12:
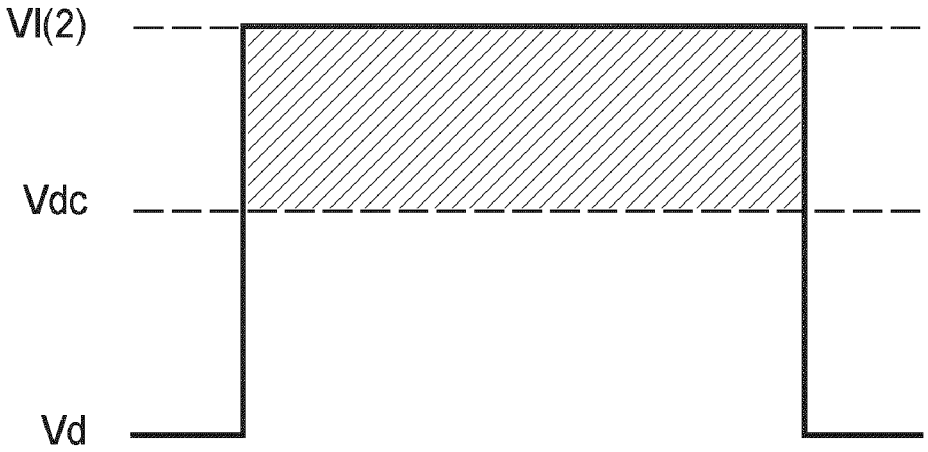
FIG. 12 is a schematic diagram showing a potential of a latent image with a halftone density during reference toner image formation.

As a result of study on the relationship by the present inventor, the relationship is satisfactorily established with respect to the uniform potential (V1(2)) of the latent image (so-called solid state image) as shown in FIG. 12. However, it was found that the relationship is not completely satisfied with respect to the uneven potential (V1(1)) of the latent image (halftone image) as shown in FIG. 11. This may be attributable to the following phenomenon.

Figure 7:
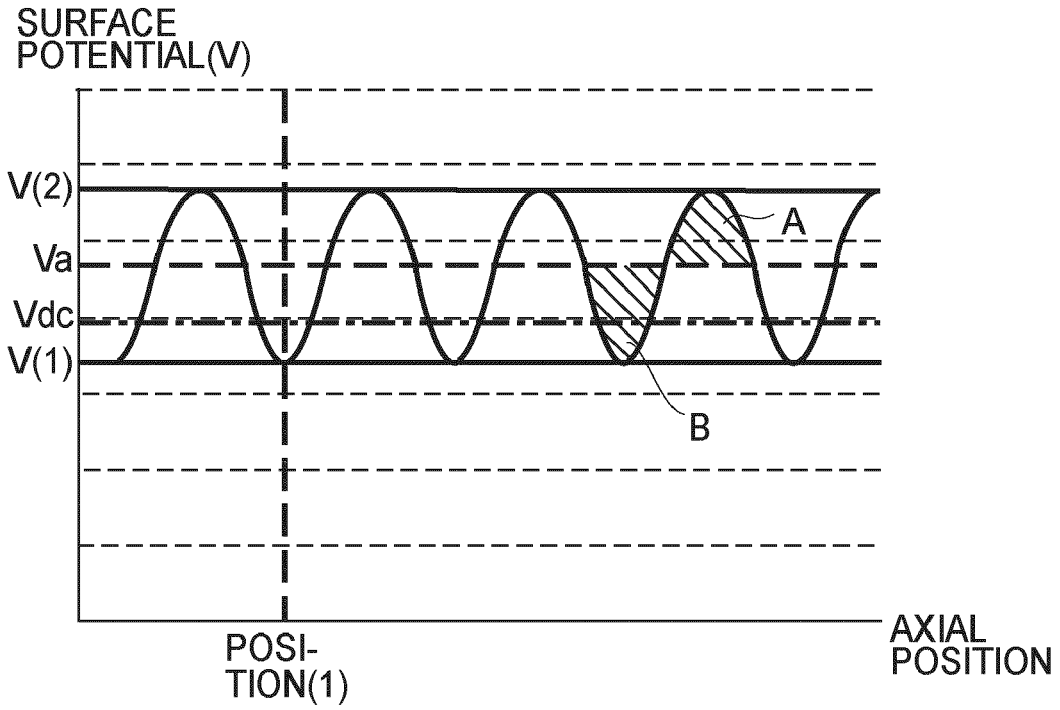
FIGS. 7 and 8 are schematic diagrams each for microscopically illustrating a potential state at a surface of a photosensitive drum.

The halftone potential during the normal image formation is, as shown in FIG. 7, microscopically in an uneven potential state at the surface of the photosensitive drum. However, with an increasing distance from the photosensitive drum surface toward the developing sleeve, a potential is uniform by superposition of electric fields by microscopic potentials V(1) at an exposed portion and V(2) at a non-exposed portion, so that on toner electric charges, a force of the electric fields is exerted in a direction toward an average potential Va of the uneven potential.

The average potential Va shown in FIG. 7 is a potential providing uneven potential areas A and B which have the same area. Further, Vdc represents a developing bias potential.

Figure 8:
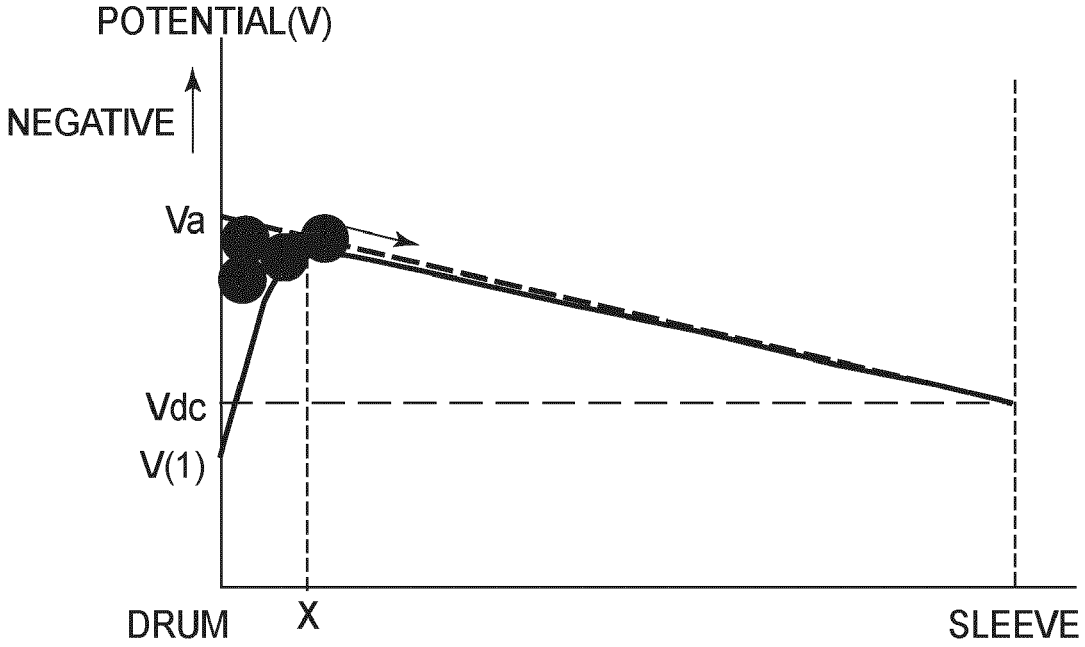
Figure 9:
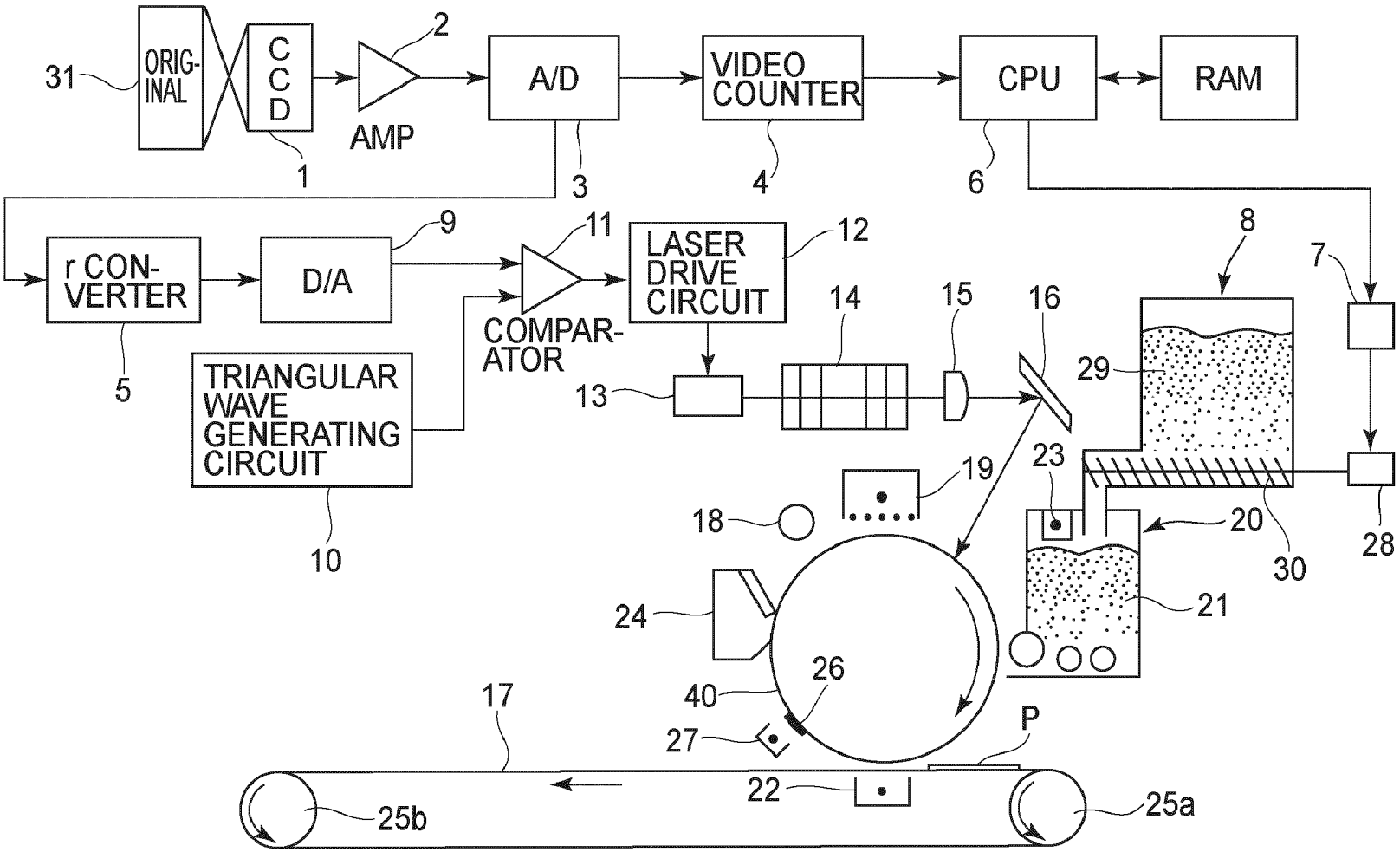
FIG. 9 is a schematic structural view showing a embodiment of a conventional image forming apparatus.

FIG. 8 shows a potential at each of positions between the photosensitive drum and the developing sleeve with respect to a position (1) shown in FIG. 7. As shown in FIG. 8, of potential gradients between the photosensitive drum and the developing sleeve, a potential gradient at a position close to the developing sleeve is formed by the average potential Va and the developing sleeve potential Vdc. On the other hand, at a position very close to the photosensitive drum, the potential is microscopically affected by the drum surface potential to be fluctuated so as to converge at the exposed portion potential V(1), so that a potential trough is formed. By this potential trough formed between the photosensitive drum surface and a position X, the toner receives a force in a direction in which the toner is attracted to the drum (i.e., is subjected to development) in this space but receives a force in a direction in which the toner is returned to the developing sleeve (i.e., is not subjected to the development) when the toner position is moved apart from the position X toward the developing sleeve. In other words, when the potential trough is completely filled with the toner, the negatively charged toner receives an electric field in which the toner does not jump, so that the development is completed.

In this way, for example, when the space between the photosensitive drum surface and the position X is filled with the toner, the development is completed even in a small electric charge amount of the toner. This means that the completion of the development does not depend on the electric charge amount of the toner filled in the space but is determined by an amount of the toner (a distance from the photosensitive drum surface to an upper layer (surface) of the toner). As a result, it is considered that the toner amount is less liable to be changed even when the toner electric charge (triboelectric charge) is changed with respect to a predetermined Vcont in the development in a microscopically uneven potential state.

Incidentally, such a phenomenon that a sensitivity of the triboelectric charge is lowered occurs in the case where the average potential Va is placed in a toner non-jumping state (a negative potential state in this embodiment) rather than a developing bias (developing potential) state. Accordingly, in order to improve the sensitivity of the triboelectric charge, the average potential Va may preferably be placed in a toner jumping state (a positive potential state in this embodiment) rather than the developing bias (developing potential) state. However, even in the case where the average potential Va is placed in the toner jumping state, when the potential trough space is filled by the development with a certain amount of the toner, the potential state is similarly placed in the state shown in FIG. 8. For this reason, the completion of the development is less liable to depend on the toner electric charge amount (triboelectric charge amount).

As a result, in the case where a latent image for the patch image with the intermediate density of about 0.5-1.0 suitably used for the patch detection ATR is formed in the same manner as during the normal image formation, the following problem arises.

The potential is placed in the microscopically uneven potential state, so that accuracy of control of the triboelectric charge in the developing apparatus is remarkably impaired even when the toner supply control is effected by detecting the patch density (toner amount).

For the reasons described above, in the present invention, during the reference patch image formation, the laser intensity is lowered, compared with that during the normal image formation, to form a latent image, in order to provide a uniform latent image potential.

Figure 3:
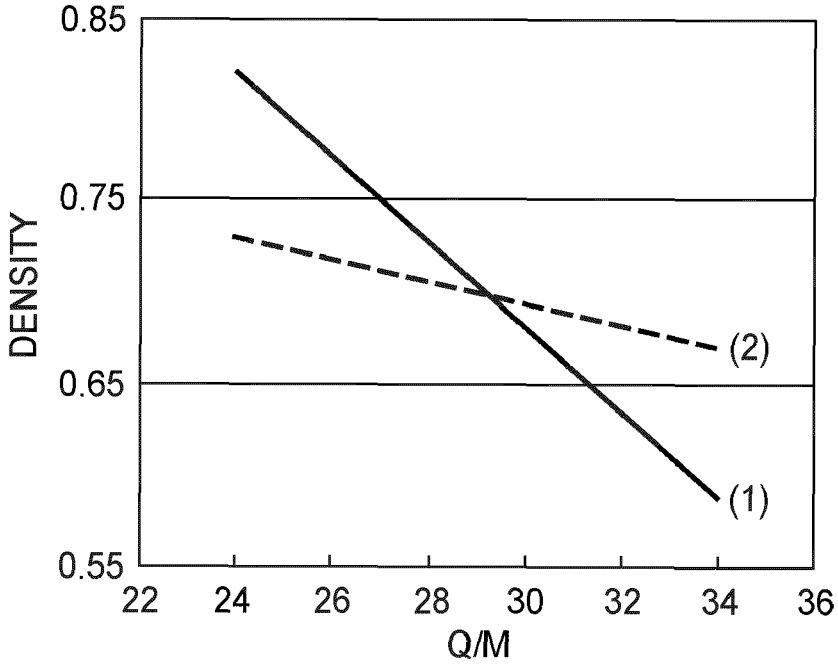
FIG. 3 is a graph showing a relationship between a toner triboelectric charge (Q/M) in a developing apparatus and a patch density.

FIG. 3 shows changes in patch image density at (1) laser power of 60% and (2) laser power of 100% (laser power during the normal image formation) when the triboelectric charge is intentionally changed, and is a graph for illustrating the action and effect of the present invention. In this case, a charge potential Vd is −500 V and a developing bias Vdc applied to the developing sleeve is −380 V.

Figure 4:
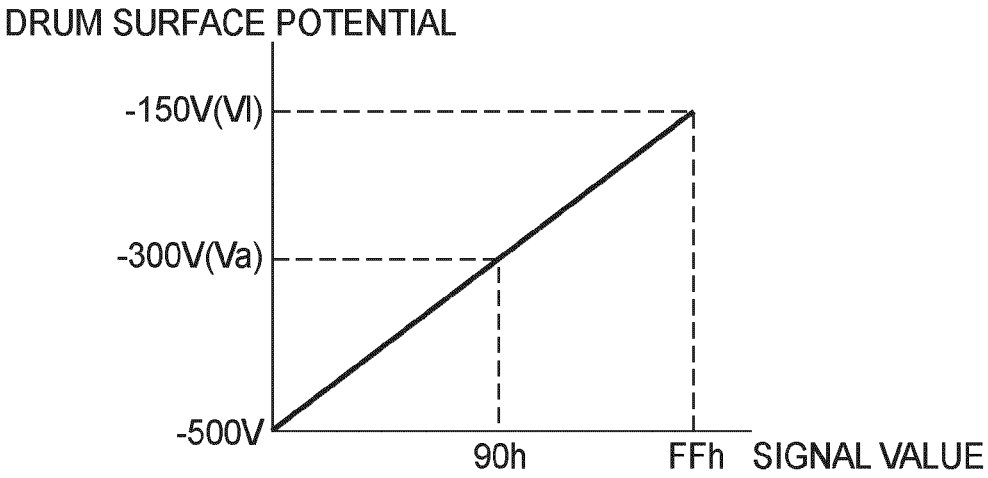
FIG. 4 is a graph showing a relationship between a pulse width signal value and a photosensitive drum surface potential during normal image formation.

During the latent image formation at (2) the laser power of 100%, as shown in FIG. 4, an exposure potential V1 during whole surface laser exposure (light emission at a signal value of FFh) is −150 V. During the patch image formation, laser beam emission is effected by pulse width modulation (signal value of 90 h (in the range from 0 to FFhex)) so as to provide an exposure potential (macroscopic average potential) Va of −300 V. Thus, Vcont is set to 80V.

Figure 6:
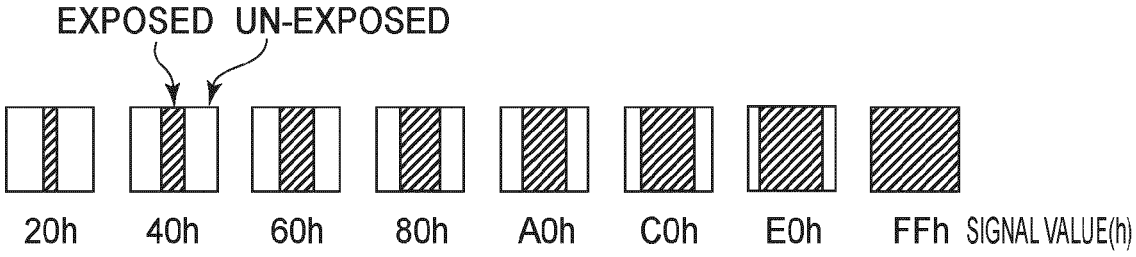
FIG. 6 is a schematic diagram showing a relationship between a signal value and an exposed area per pixel by pulse width modulation.

FIG. 6 is a schematic diagram showing a relationship between a signal value and an exposed area per one pixel by the pulse width modulation.

On the other hand, during the latent image formation at (1) the laser power of 60%, a laser intensity is changed to 60% of that for the solid latent image and is used for the laser beam exposure. The exposure potential is lowered by an amount corresponding to a decrement of the laser intensity, so that the laser beam emission is effected by the whole area exposure (signal value of FFh (0 to FFhex)), i.e., so as to expose the entire area of one pixel to the laser beam. In this case, the exposed portion potential is −300 V. Thus, Vcont is set to 80 V.

The potential of the photosensitive drum is measured by a surface electrometer ("Model 334", mfd. by Trek Japan K. K.) and all the values of the potentials in this embodiment are those measured by this surface electrometer.

In the above-described conditions, both of densities of patch images prepared by developing the latent images formed with a toner triboelectric charge of about 30 μC/g at (1) the laser power of 60% and (2) the laser power of 100% were 0.7. The patch image densities when the triboelectric charge is intentionally changed during the latent image formation at the above two laser powers (1) and (2) are shown in FIG. 3. A sensitivity of the patch image density with respect to the toner triboelectric charge in the case of forming the latent image at (1) the laser power of 60% if found to be about 1.3 times that in the case of forming the latent image at (2) the laser power of 100%. In other words, when the density of the patch image obtained from the latent image formed at (1) the laser power of 60% is used during the patch detection ATR, it is possible to control the toner triboelectric charge in the developing apparatus with an accuracy which is about 1.3 times that of the case where the density of the patch image obtained from the latent image formed at (2) the power of 100% is used during the patch detection ATR.

In this embodiment, in order to enhance the triboelectric charge sensitivity during the patch image formation, when a patch image with a target density is formed, control of switching of an exposure light quantity (exposure condition) compared with that during the normal image formation is effected in the following manner. Compared with during the normal image formation, the patch detection ATR is performed by forming the electrostatic latent image in a condition such that the laser power is lowered to change the amount of exposure so as to increase the exposure area per pixel. More specifically, the laser power (exposure intensity) and laser emission time for forming the patch image are changed by a reference image signal generating circuit 72 as a switching means for switching the laser power and the exposure area per pixel. In this case, the switching of the laser power (exposure intensity) is performed by decreasing a driving current for actuating the laser compared with the case of during the normal image formation, thus switching the exposure condition so as to decrease the exposure intensity.

Conditions for the patch detection ATR includes, as described above, the charging potential Vd of −500 V, the developing bias Vdc applied to the developing sleeve of −380 V, and the exposed portion potential Vb of −300 V. Thus, Vcont is set to 80 V. In this case, the exposed portion potential is formed by the laser beam emission at a laser intensity value, which is 60% of that during the normal image formation, with a signal value FFh (0 to FFhex) provided by the pulse width modulation. In this embodiment, (Embodiment 1), in the developer having the T/D ratio of 8%, the toner triboelectric charge is about 30 μC/g. In this case, the density of the patch image formed under the above-described potential conditions is about 0.7, which is used as an initial image density. Incidentally, the patch image density may be in a density range (0.5-1.0) in which the density sensor 73 for the patch detection ATR has a high reading sensitivity. The patch image density means an image density corresponding to an intermediate (halftone) density level during the normal image formation when measured by the optical density sensor as the density detecting means.

The resultant patch image (toner image) is irradiated with light from the light-emitting portion 73*a* of the density sensor for the patch detection ATR and reflected light from the patch image is received by the light-receiving portion 73*b* of the photoelectric conversion element to detect an actual patch image density of the patch image.

An output signal which detects the actual patch image density from the light-receiving portion 73*b* is supplied to one of the inputs of a comparator 75. To the other input of the comparator 75, a reference signal corresponding to the initial image density of the patch image is inputted from a reference voltage signal source 76. The comparator 75 compares the patch image density and the initial image density to calculate a density difference therebetween and supplies an output signal of the density difference to the CPU 67.

Figure 5:
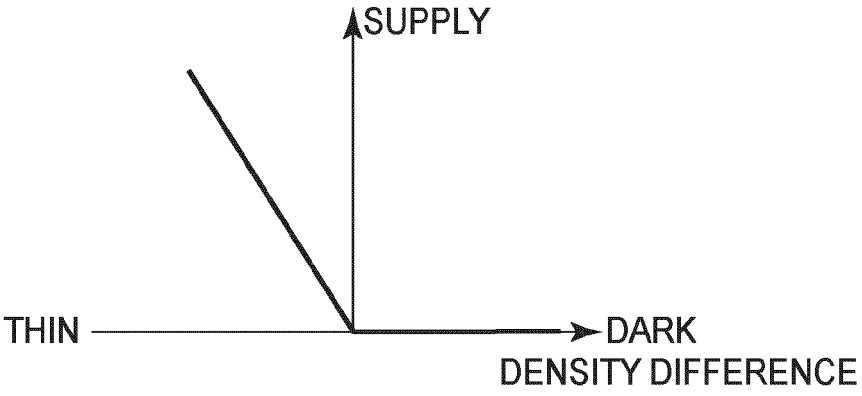
FIG. 5 is a schematic diagram showing a relationship between an output value of patch detection and a supply amount.

The output signal of the density difference is used in the supply control of the toner to the developer 43 in the developing apparatus 44 according to the relationship shown in FIG. 5. The toner supply control is effected to correct the change in the triboelectric charge in the developing apparatus with respect to a reference triboelectric charge by the toner supply.

For example, in the case where it is detected that the patch image density is lower than a pre-set reference density, this is comparable to a higher toner triboelectric charge compared with the reference value, so that the T/D ratio is increased by supplying the toner in order to lower a current amount of the triboelectric charge. On the other hand, in the case where it is detected that the patch image density is higher than the pre-set reference density, this is comparable to a lower toner triboelectric charge compared with the reference value, so that the T/D ratio is decreased by toner consumption by image formation after the toner supply is stopped, in order to increase the current amount of the triboelectric charge.

Incidentally, the above-described laser power value (60% of that during the normal image formation) and the signal value FFh for the pulse width modulation are one example capable of forming a latent image in a uniform potential state with the halftone (optical) density of 0.5-1.0 in the image forming apparatus of this embodiment but the present invention is not limited thereto. As a result of study by the present inventor, it was found that the accuracy of the triboelectric charge control by the patch detection ATR is improved since the potential is caused to approach a flat level compared with that during the normal image formation at least by decreasing the laser power to 80% or less compared with that during the normal image formation and setting the patch image density to about 0.5-1.0.

The area of the patch image may be a minimum area in which the patch image density can be measured in view of the toner consumption. Generally, the patch image area is 80% or less of that at the laser power during the normal image formation.

The image forming apparatus of this embodiment includes image forming stations for four colors of yellow, magenta, cyan and black. Accordingly, at each of the respective color image forming stations, the patch image for each color is subjected to density detection and comparison with the initial image density in the above-described manner to provide a density difference between the actual image density of each color patch image and the initial image density, so that a resultant output signal of the density difference is supplied to the CPU 67.

As described above, the present invention has features below in the toner supply control method (patch detection ATR) in which the patch image for density reference is formed on the photosensitive drum and the image density thereof is detected by the image density sensor to be used for the toner supply control. In the present invention, the patch image with the halftone density obtained from the latent image formed by decreasing the laser intensity compared with the case of during the normal image formation is used. For this reason, the patch image density satisfactorily reflects the triboelectric charge in the developing apparatus, so that it is possible to appropriately and stably control the triboelectric charge of the toner in the developing apparatus.

In the present invention, the formation and detection of the patch image with the halftone density are carried out by using the latent image increased in exposure area by lowering the laser power. As a result, the patch image density can satisfactorily reflect the triboelectric charge, so that the accuracy of the triboelectric charge control, i.e., the T/D control of the developer.

Further, in the present invention, the patch image formation can be arbitrarily effected only in a patch image detectable range, so that there is no unnecessary toner consumption.

Further, in the present invention, the patch image formation is carried out by changing only the laser power, so that it can be effected, e.g., in the non-image area or during sheet interval simultaneously with the normal image formation. As a result, downtime due to the patch detection ATR does not occur.

Embodiment 2

In Embodiment 1, conditions for the patch detection ATR includes the charging potential Vd of −500 V, the developing bias Vdc applied to the developing sleeve of −380 V, and the exposed portion potential Vb of −300 V. Thus, Vcont is set to 80 V. In this case, the exposed portion potential is formed by the laser beam emission at a laser intensity value, which is 60% of that during the normal image formation, with a signal value FFh (0 to FFhex) provided by the pulse width modulation.

However, due to the exposure potential change or the like by charge and exposure sensitivities and environmental characteristic of the photosensitive drum, a similar latent image potential cannot be generated even when the charging under the same condition and the exposure at the same laser power are effected in some cases. In these cases, Vcont during the patch image formation is deviated from a target Vcont (80 V in this embodiment) with the result that the triboelectric charge in the developing apparatus can be controlled so that it is also deviated from an estimated value.

In this embodiment (Embodiment 2), after the developing contrast potential is set to a desired value (80 V in this embodiment) by providing a potential sensor 80 for detecting the surface potential of the photosensitive drum in view of the changes in environment and durability of the photosensitive drum. That is, the potential control is effected by providing the potential difference between the exposure potential for preparing the patch image and the developing bias applied to the developing sleeve so as to be the predetermined potential difference value by the known potential control. As the means for changing the exposure potential, it is possible to select the change in laser power or the change in pulse width (emission time length) but either one of these can be selected so long as the laser power is lowered at least compared with that during the normal image formation. In a preferred embodiment, the signal value for the pulse width modulation is close to the signal value FFh in order to provide a uniform potential state. As a result, even when the charging and exposure characteristics of the photosensitive drum are changed due to the environmental change, deterioration in durability, and the like, it is possible to always form the patch image by the reference Vcont. For this reason, by the density of the patch image obtained by the proper potential, it is possible to control the triboelectric charge in the developing apparatus with accuracy.

As described above, in this embodiment (Embodiment 2), the patch detection ATR is carried out after the developing contrast potential is adjusted to the desired Vcont value through the potential control by providing the potential sensor for detecting the photosensitive drum potential. For this reason, e.g., even in the case where the characteristic of the photosensitive drum is changed by the environmental change, it is possible to appropriately and stably control the triboelectric charge of the toner in the developing apparatus by the patch detection ATR.

As described above, according to the present invention, it is possible to form a good image for a long term while keeping the change in coloring and the change in density at low levels.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 346802/2006 filed Dec. 22, 2006, which is hereby incorporated by reference.

What is claimed is:

1. An image forming apparatus comprising:

an image carrying member for carrying a toner image;

exposure means for forming an electrostatic latent image by exposing said image carrying member to light on the basis of image information;

developing means for developing the electrostatic latent image with a developer comprising toner and a carrier;

density detecting means for detecting a density of a reference toner image formed by said developing means;

supply control means for controlling an amount of toner supplied to said developing means on the basis of a detection result of said density detecting means;

exposure area control means for controlling an exposure area per pixel of said exposure means on the basis of the image information during normal image formation for forming a toner image on a recording material; and switching means for switching an exposure condition for forming an electrostatic latent image corresponding to the same density level between during reference toner image formation and during the normal image formation, wherein said switching means switches the exposure condition so that an exposure intensity during the reference toner image formation is smaller than that during the normal image formation and an exposure area per pixel during the reference toner image formation is larger than that during the normal image formation.

2. An apparatus according to claim 1, wherein the density of the reference toner image corresponds to an intermediate density level during normal image formation.

3. An apparatus according to claim 2, wherein the intermediate density level is an optical density of 0.5-1.0.

4. An apparatus according to claim 1, wherein the reference toner image is formed by whole surface exposure by said exposure means.

5. An apparatus according to claim 1, wherein the exposure intensity during the reference toner image formation is an output which is 80% or less of an exposure intensity during the normal image formation.

6. An apparatus according to claim 1, wherein an exposure potential of the electrostatic latent image for the reference toner image is formed so as to transfer the toner with respect to a developing potential to be applied to said developing means.

* * * * *